United States Patent [19]

VanErden

[11] Patent Number: 4,923,701

[45] Date of Patent: May 8, 1990

[54] ZIPPERED COOK-IN-BAG POUCH AND METHOD

[75] Inventor: Donald L. VanErden, Wildwood, Ill.

[73] Assignee: Minigrip, Inc., Orangeburg, N.Y.

[21] Appl. No.: 296,078

[22] Filed: Jan. 12, 1989

[51] Int. Cl.[5] ..... B65D 27/06; B65D 27/18

[52] U.S. Cl. ..... 426/113; 426/112; 426/410; 426/412; 383/63; 383/65; 383/94; 383/95

[58] Field of Search ..... 426/113, 112, 107, 412, 426/411, 118, 106; 383/63, 64, 65, 94, 95

[56] References Cited

U.S. PATENT DOCUMENTS

| | | | |
|---|---|---|---|
| 3,339,606 | 9/1967 | Kugler | 150/3 |
| 3,440,696 | 10/1965 | Staller | 24/201 |
| 3,625,270 | 4/1970 | Skendzk | 150/3 |
| 3,679,511 | 7/1972 | Ausnit | 156/251 |
| 3,827,472 | 8/1974 | Uramoto | 150/3 |
| 3,865,302 | 2/1975 | Kane | 426/113 |
| 4,032,492 | 7/1977 | Englund et al. | 215/233 |
| 4,358,466 | 11/1982 | Stevenson | 426/106 |
| 4,410,130 | 10/1983 | Herrington | 383/62 |
| 4,685,273 | 8/1987 | Caner et al. | 53/440 |

OTHER PUBLICATIONS

Adhesives Addition 4 D.A.T.A., Inc. & The International Plastic Selector, Inc., 1986.

"What Are Today's Trends in Europe and Japan", Feb. 1986, Packaging.

List of Resin and Adhesives, including EVA.

Zipper Tubing Catalog of Alpha Wire Corporation.

Minigrip, Inc. Industrial Zippers and Plastic Closures.

Food and Drug Chapter 1, Food and Drug Administration Section 175.105, pp. 124–139.

Government Regulations FDA Status/TSCA Status, p. 29.

Food and Drug Administration (FDA) Status, p. 5.

U.S. Industrial Chemicals Company, p. 3, Describing Various Coatings and Adhesives, Including EVAs.

*Primary Examiner*—Donald E. Czaja

*Assistant Examiner*—D. Workman

*Attorney, Agent, or Firm*—Hill, Van Santen, Steadman & Simpson

[57] ABSTRACT

A zippered cook-in-bag pouch and method wherein the pouch and a profiled extruded plastic zipper structure at the mouth of the pouch body are formed from material which will withstand substantially without deterioration maximum cooking heat to which contents within the pouch may be subjected when cooking the contents. A set hot melt adhesive between the profiles bonds the profiles tenaciously against separation at room temperature. The adhesive is sufficiently softenable at a temperature substantially above room temperature but near the cooking temperature, for releasing the profiles for opening the pouch body. The adhesive is settable to a nontacky state in respect to the separated profiles when the adhesive temperature drops below the softenable temperature of the adhesive so that the zipper can then be reclosed and opened at will without adhesive interference.

6 Claims, 1 Drawing Sheet

FIG. 1
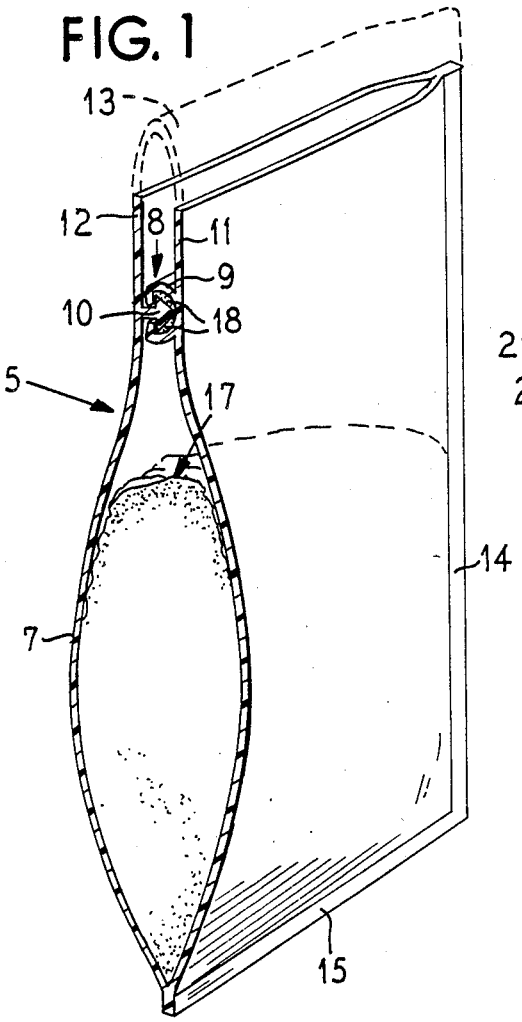
FIG. 3
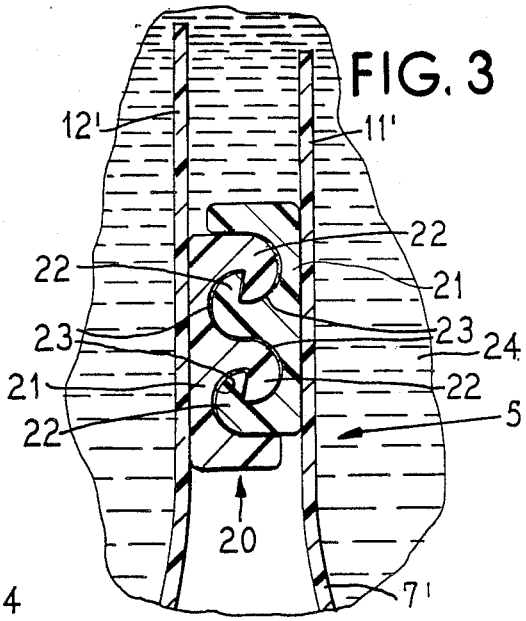
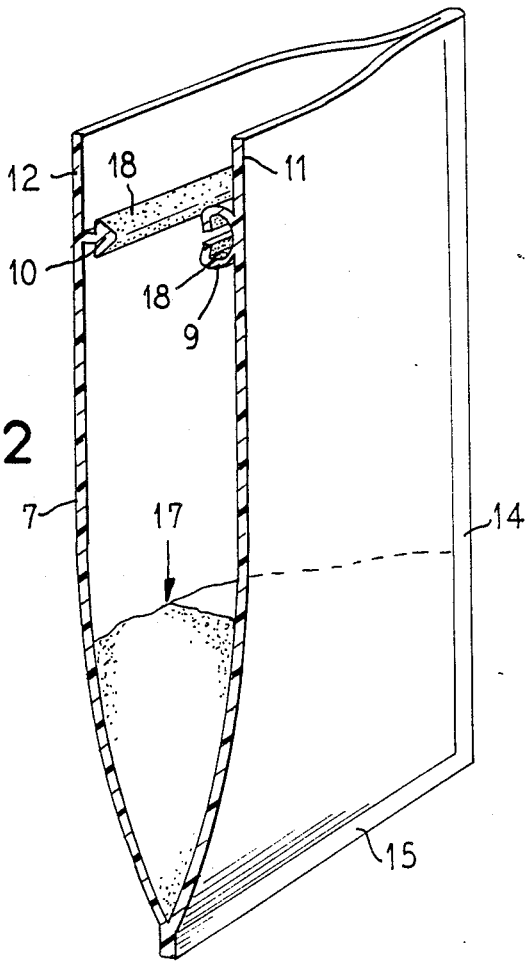
FIG. 2

ZIPPERED COOK-IN-BAG POUCH AND METHOD

FIELD OF THE INVENTION

This invention relates to improvements in cook-in-bag pouches, and is more particularly concerned with pouches of this type which are equipped with zippers adapted for opening and closing the zippered pouch mouth at will.

Bag-enclosed food contents may be conveniently cooked within the bag where the bag material is suitable for that purpose, such as aluminum foil or a high melting point plastic film. Generally, such pouches are permanently sealed against opening in the presence of cooking heat. After the cooking process has been completed conventional pouches are generally destroyed in order to gain access to the cooked contents. Such destruction of the bag or pouch generally requires the user to find some other container for preserving any remainder of the cooked food.

PRIOR ART

While it has been proposed in U.S. Pat. No. 4,358,466 to provide a zippered cook-in-bag pouch stucture, no provision has been made for avoiding unauthorized access into the bag pouch through the zipper equipped opening, or to prevent escape of contents by unintentional opening of the zipper during handling or storage of the filled pouch.

U.S. Pat. No. 3,827,472 discloses a tamper evident bag equipped with zipper closure and with means for facilitating ripping off a top fold above the zipper when it is desired to gain access into the bag. Nothing is disclosed in this patent for retaining the zipper closed until it is desired to open the zipper, nor is there any disclosure of any cook-in-bag capability for the disclosed bag construction.

U.S. Pat. No. 3,440,696 discloses an arrangement for attaining a tight seal between the profiles of a zipper type closure by means of a soft compressible sealing material. The sealing material is applied to the zipper profiles in such a manner that when the zipper is closed, the sealing material is compressed between the zipper surfaces. It is indicated that the arrangement is suitable for separation by a slider or by pulling the zipper open. There is no indication that the sealing material has any adhesive quality. In other words, the sealing is effected by dry surface engagement wherein the soft compressible sealing material is placed under compression.

U.S. Pat. No. 3,339,606 discloses the use of pressure sensitive adhesive for retaining a groove and rib closure, wherein the adhesive serves as a substitute for the usual extruded plastic zipper interhooked profile arrangement.

SUMMARY OF THE PRESENT INVENTION

It is an important object of the present invention to povide a new and improved zippered cook-in-bag pouch construction, and method, wherein the zipper profiles are bonded together by a set hot melt adhesive until subjected to softening heat during a cooking process.

In accordance with the principles of the present invention, there is provided a zippered cook-in-bag pouch, and method, comprising provision of a pouch having a mouth and a zipper comprising a profiled extruded plastic structure having a pair of complementary reclosably interlockable zipper strips attached permanently to the pouch in closing relation to the puch mouth. The pouch body and zipper are formed from material which will withstand substantially without deterioration maximum cooking heat to which a contents within the pouch may be subjected when cooking the contents. There is provision of a set hot melt adhesive between the profiles for bonding the profiles tenaciously against separation at room temperature. The adhesive is sufficiently softenable at a temperature substantially above room temperature, but no greater than the maximum cooking heat, for releasing the profiles for opening the pouch mouth. The adhesive is settable to a nontacky state in respect to the separated profiles when the adhesive temperature drops below the temperature at which the adhesive is softenable, so that the zipper can then be opened and closed at will without adhesive interference.

BRIEF DESCRIPTION OF THE DRAWINGS

Other objects, features and advantages of the present invention will be readily apparent from the following description of representative embodiments thereof, taken in conjunction with the accompanying sheet of drawings, although variations and modifications may be effected without departing from the spirit and scope of the novel concepts embodied in the disclosure, and in which:

FIG. 1 is a fragmentary perspective view of a closed zippered cook-in-bag pouch embodying features of the invention;

FIG. 2 is a similar view showing the bag opened; and

FIG. 3 is a perspective view of a modification of such pouch.

DETAILED DESCRIPTION

On referring to FIGS. 1 and 2, a zippered cook-in-bag pouch 5 comprises a pouch body 7 and a zipper 8 which comprises a profiled extruded plastic structure having a pair of complementary reclosable interlockable zipper strips which in this instance comprise a female channel shaped zipper strip 9 and a complementary rib-like male zipper strip 10. The zipper strips 9 and 10 may be attached to the body 7 in any desired manner, such as by integral plastic extrusion with the body material of the pouch 5, or as prefabricated strips secured as by fusion or adhesive bonding to the pouch body material, whatever that material may be, such as plastic film, paper, combination plastic and paper, and the like. In a desirable location of the zipper 8, the zipper strips 9 and 10 are attached along the inner or lower end portions of opposite pull flanges 11 and 12 by which the zipper 8 is adapted to be opened by pulling the pull flanges apart and thereby disengaging the zipper strips 9 and 10 from one another.

If desired, the upper ends of the pull flanges 11 and 12 may be connected by a positive tamper evident loop or fold 13 in similar fashion as disclosed in U.S. Pat. No. 3,827,472. When legitimate entry into the pouch 5 is desired, the loop 13 is removed from the pouch. At opposite sides of the pouch 5 (only one of such sides being shown and it being understood that both sides of the bag may be treated the same) side seals 14 close the pouch, including the opposite sides of the pull flanges 11 and 12. A similar closure seal 15 may be effected along the bottom end of the pouch 15 where, for convenience, the lower ends of the wall panels defining the pouch are left initially open for filling the pouch with a contents 17 to be enclosed and maintained in packaged assembly within the pouch until subjected to a cook-in-bag cooking preparation.

According to the present invention, the zipper 8 is sealed in a manner to remain selectively sealed against opening at room temperature and requires a temperature above room temperature for release of the seal and opening of the zipper.

In a preferred arrangement, hot melt adhesive 18 is applied between the complementary profiles of the zipper strips 9 and 10. The adhesive 18 is adapted to be applied at a suitable point in the manufacture of the pouch 5. One technique that may be employed for this purpose is exemplified in U.S. Pat. No. 3,440,696. The adhesive 18 should be a nonsolvent formulation based on thermoplastic polymers selected from any desirable commercially available adhesive of this type which will be solidly set at room temperature and at least at such temperature safely bond the zipper profiles tenaciously against separation. Within a temperature which is substantially above room temperature and near the maximum cooking heat to which the pouch package may be subjected during a cooking procedure, the adhesive should be sufficiently softenable to permit manually pulling apart and releasing the zipper profiles for opening the pouch mouth. It is desirable that regardless of the liquid phase temperature of the adhesive, it must adhere to zipper profile surfaces even when the adhesive becomes sufficiently soft to permit the zipper profiles to be separated for opening the zipper.

For boiling water cooking uses, the hot melt adhesive 18 should be sufficiently softenable in a range of about 150° F. to about 197° F. By way of example, several nonsolvent adhesive formlations based on thermoplastic polymers are obtainable from Bostik/Emhart and having application temperature ranges from about 150° F. to 197° F. and are identified as Thermal Grip 6370, 6383N, 8330, 6323, 6330 and 6363. Should there be any tendency for the softened adhesive to be stringy when the zipper profiles are pulled apart, suitable additives may be incorporated in the formulation to alleviate this condition.

In a cooking procedure, the pouch package equipped with the hot melt adhesive sealed zipper 8 is placed in the cooking enviroment, such as boiling water, and since the adhesive 18 will not soften below a temperature substantially above room temperature, the food product 17 will be substantially heated toward the cooking temperature before the adhesive 18 will soften. Because of the interlocked condition of the zipper profiles, the zipper will remain closed until the cooking process is completed and the package removed from the cooking environment and opened by pulling the flanges 11 and 12 apart and thus opening the zipper for discharge access to the cooked food 17. By then leaving the zipper 8 open as shown in FIG. 2 until temperature of the adhesive on the zipper profiles has reset to a nontacky state in respect to the separated profiles, the zipper can be reclosed and opened at will without adhesive interference. Of course, if it is desired to reseal, and not just reclose, the zipper after removal of some of the cooked contents, that may be effected, if the zipper is reclosed while the adhesive is still in a tacky state.

Although the zipper 8 in FIGS. 1 and 2 is of the single male and female profile type, the invention is equally applicable to a multiprofile type of zipper exemplified in FIG. 3 wherein the pouch 5' may in other respects be substantially the same as the pouch 5 in FIGS. 1 and 2. In the pouch 5' there is attached to the inner side of the pouch body 7' adjacent to the mouth end of the pouch a zipper 20 which has preferably generally identical mirror image zipper strips 21, each of which has a plurality of similar generally hook-shaped rib-like profiles 22 which are interchangeable interlockingly in the closed condition of the zipper. Applied to the interengaging surfaces of the zipper profiles 22 is hot melt adhesive 23 which may be substantially the same as the adhesive 18 in FIGS. 1 and 2 and serving the same purposes.

By way of example, the pouch 5' is shown as immersed in a cooking liquid 24. This illustration is equally applicable to the pouch 5 of FIG. 1. On the other hand, the open pouch showing in FIG. 2 is applicable as well as to the pouch 5' in FIG. 3.

It will be understood, of course, that the pouch bodies 7 and 7' and the zippers 8 and 8' are formed of material which will withstand substantially without deterioration maximum heat during a cooking procedure to which the pouches and zippers may be subjected when cooking contents within the pouches. Plastics that will meet such requirements are known in this art, for example, nylon, polypropelene, high density polyethylene resins.

It will be understood that variations and modifications may be effected without departing from the spirit and scope of the novel concepts of the present invention.

I claim as my invention:

1. A zippered cook-in-bag pouch, comprising a pouch body having a mouth, and comprising:

a profiled extruded plastic zipper structure comprising a pair of complementary manually manipulatable zipper strips having reclosably interlockable profiles and the strips being attached permanently to said pouch in closing relation to said pouch mouth;

said pouch body and zipper structure being formed from material which will withstand without deterioration at least a boiling heat temperature during a cooking procedure to which the pouch and the zipper may be subjected when cooking contents within the pouch;

a set hot melt adhesive between said profiles for bonding the profiles tenaciously against separation at room temperature;

said adhesive being sufficiently softenable within a temperature range of 150° F. to 197° F. for permitting manually releasing said profiles for opening said pouch mouth; and said adhesive being setable to a non-tacky state in respect to the separated profiles when the adhesive temperature is below said 150° F. softenable temperature, so that in said non-tacky state the zipper structure can be manually reclosed and opened at will without adhesive interference.

2. A pouch according to claim 1, wherein said adhesive comprises nonsolvent formulations based on thermoplastic polymers.

3. A method of handling and cooking a contents in a zippered cook-in-bag pouch, comprising:

providing a pouch body having a mouth and a zipper comprising a profiled extruded plastic structure having a pair of complementary zipper strips having reclosably interlockable profiles and the strips being attached permanently to said pouch in closing relation to said pouch mouth;

forming said pouch body and zipper from material which will withstand without deterioration at least a boiling heat temperature during a cooking procedure to which the pouch and the zipper may be subjected when cooking the contents;

placing said contents into said pouch;

providing a hot melt adhesive which is set at room temperature between said profiles and thereby bonding the profiles tenaciously against separation at room temperature;

providing said adhesive in a formulation which is sufficiently softenable within a temperature range of 150° F. to 197° F. for permitting manually releasing said profiles when heated within said range for opening said pouch mouth;

subjecting said pouch and contents to cooking temperature and thereby releasably softening said adhesive;

after said cooking temperature softening of the adhesive opening said pouch by separating said profiles; and while maintaining the profiles separated effecting setting of t he adhesive to a non-tacky state in respect to the separated profiles when the adhesive temperature drops below said softenable temperatures, so that in said non-tacky state the zipper can be reclosed and opened at will without adhesive interference.

4. A method according to claim 3, which comprises providing said adhesive in nonsolvent formulations based on thermoplastic polymers.

5. A method of handling and cooking a contents in a zippered cook-in-bag pouch, comprising:

providing a pouch body having a mouth and a zipper comprising a profiled extruded plastic structure having a pair of complementary zipper strips having reclosably interlockable profiles and the strips being attached permanently to said pouch in closing relation to said pouch mouth;

forming said pouch body and zipper from material which will withstand without deterioration at least a boiling heat temperature during a cooking procedure to which the pouch and the zipper may be subjected when cooking the contents;

placing said contents into said pouch;

providing a hot melt adhesive which sets at room temperature between said profiles and thereby bonding the profiles tenaciously against separation at room temperature;

providing said adhesive in a formulation which is sufficiently softenable within a temperature range of 150° F. to 197° F. for permitting manually releasing said profiles when heated within said range for opening said pouch mouth;

subjecting said pouch and contents to cooking temperature and thereby releasably softening said adhesive;

after said cooking temperature softening of the adhesive opening said pouch by separating said profiles; for access to the cooked contents;

and while the adhesive is still tacky reclosing the zipper and permitting the adhesive to set for resealing the zipper at substantially room temperature.

6. A method according to claim 5, which comprises providing said adhesive in nonsolvent formulations based on thermoplastic polymers.

* * * * *